United States Patent [19]

Marowsky

[11] 3,961,650

[45] June 8, 1976

[54] WEAVING METHOD AND MACHINE

[76] Inventor: Ruthard Marowsky, Kreuzbergstrasse 56, D-5630 Remscheid 12, Germany

[22] Filed: Jan. 22, 1974

[21] Appl. No.: 435,491

[30] Foreign Application Priority Data

Jan. 22, 1973 Germany ..... 2302949

[52] U.S. Cl. ..... 139/291 R; 139/291 C; 28/1 CS; 28/73

[51] Int. Cl.[2] ..... D03D 49/00; D03J 1/06; D03J 1/08

[58] Field of Search ..... 139/291 R, 291 C, 292, 139/294, 407; 28/1 CS, 72 CS, 73

[56] References Cited

UNITED STATES PATENTS

| | | | |
|---|---|---|---|
| 1,392,939 | 10/1921 | Hathaway | 139/291 R |
| 2,035,138 | 3/1936 | Maxfield | 28/1 CS |
| 2,413,672 | 12/1946 | Zollikofer | 139/291 C |
| 2,628,412 | 2/1953 | Vera | 28/1 CS |
| 3,313,323 | 4/1967 | Calemard | 139/291 C |
| 3,426,807 | 2/1969 | Pfarrwaller | 139/294 X |
| 3,489,184 | 1/1970 | Bernath | 139/291 C |
| 3,824,774 | 7/1974 | Kobayashi | 139/291 C |

FOREIGN PATENTS OR APPLICATIONS

| | | | |
|---|---|---|---|
| 625,921 | 8/1961 | Canada | 139/291 C |
| 857,664 | 12/1970 | Canada | 139/291 R |
| 290,674 | 8/1928 | United Kingdom | 139/292 |
| 944,231 | 12/1963 | United Kingdom | 139/292 |
| 1,006,944 | 10/1965 | United Kingdom | 139/291 R |
| 1,033,276 | 6/1966 | United Kingdom | 139/291 R |

*Primary Examiner*—James Kee Chi
*Attorney, Agent, or Firm*—Charles W. Helzer

[57] ABSTRACT

A method and apparatus are provided for cutting a plurality of patterned strips, suitable for labels, from a broadly woven fabric formed from threads of synthetic material on a broad fabric weaving machine. The weaving is carried out under low warp tension to produce a boxing condition and obviate weft arching. After weaving, the broad woven fabric is guided from the output of the machine at the point where the sley beats up the fabric towards the breast beam to inhibit movement in the reverse direction. This guiding is effected by passing the fabric into an undercut slot, round a bar, and out of the slot again. The guided fabric is then cut into strips and the cut edges of the strips are melted almost simultaneously to weld the same against rippling with the two functions being effected almost simultaneously by use of electrically heated wire/plate pairs arrayed across the width of the fabric according to the desired width for the strips. As a final step, the strips are heated again, in an overall manner, across the machine to relieve tensile stress variations by thermo-stabilization.

6 Claims, 7 Drawing Figures

WEAVING METHOD AND MACHINE

This invention relates to the cutting of strips, particularly woven labels of fully synthetic yarns woven by use of a broad fabric weaving machine.

While it is possible to produce patterned strips suitable for labels on a conventional jacquard strip machine, various attempts have been made over a long period of time to produce such strips in a multiple manner on a broad weaving machine with subsequent cutting into desired width strips in order to so reduce the production costs of the woven strips to a level competitive with the printed labels normally used for cheaper textiles.

However, these attempts meet a main difficulty in the form of an unavoidable phenomenon which arises in all broad fabric weaving machines, namely, the so-called weft arching.

Figure 4:
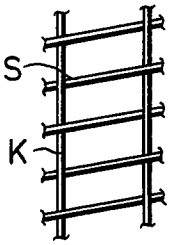
Figure 5:
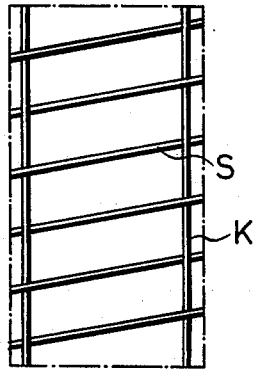
Figure 6:
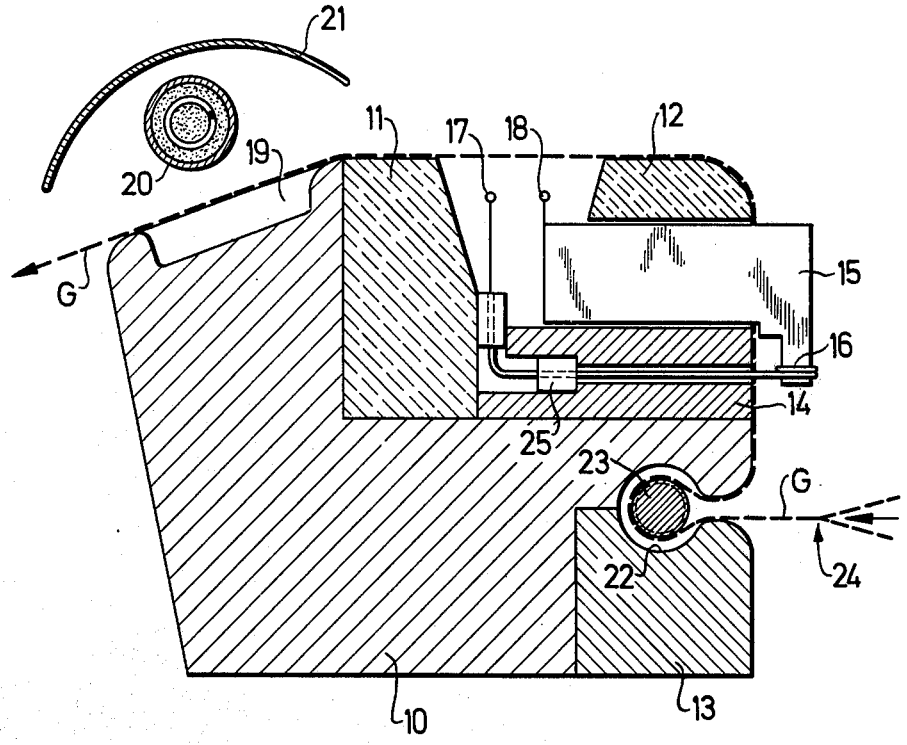
Figure 7:
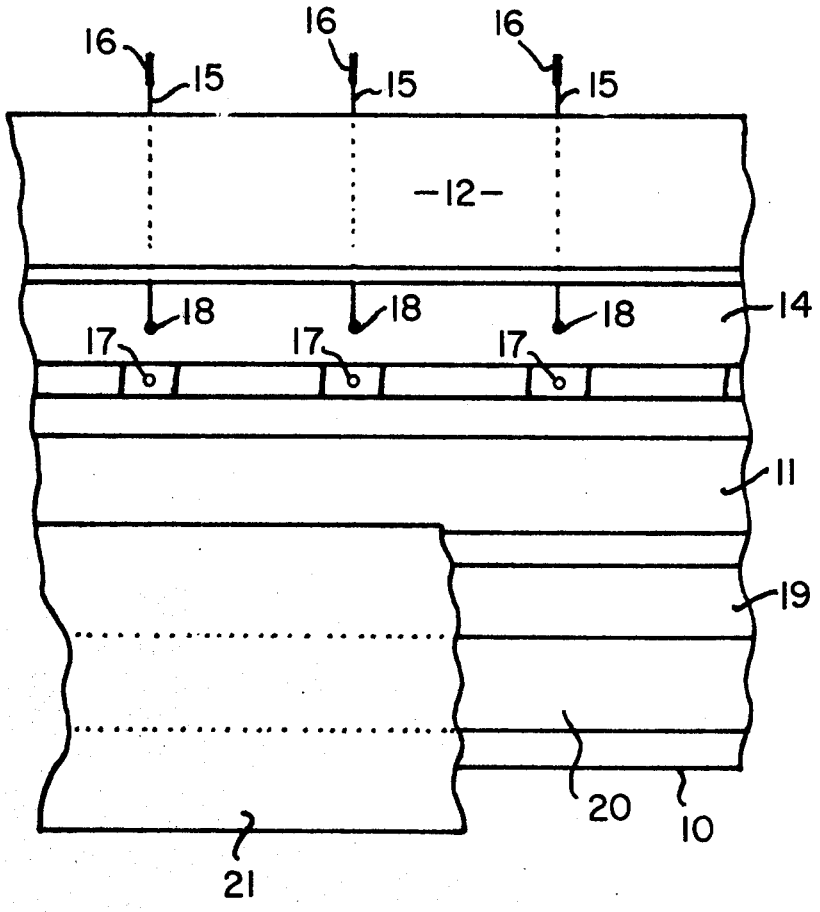

In order to clarify this phenomenon and, thereafter, the present invention, reference will be made to the accompanying drawings, in which:

FIGS. 1–5 schematically illustrate portions of fabric produced by a conventional broad weaving machine, and FIGS. 6 and 7 diagrammatically illustrate, by way of example, guiding, cutting and heating stations for attachment to a broad weaving machine according to the invention.

Figure 1:
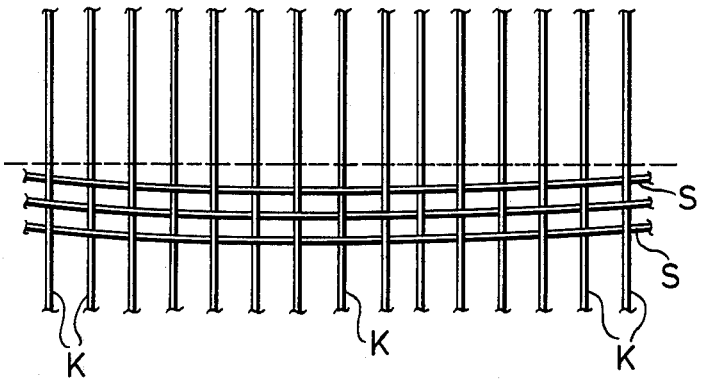

FIG. 1 shows in schematical plan view a length of fabric produced by a conventional broad weaving machine. The warp threads are symbolically represented by K and the weft threads by S. As the comparison with the broken straight line in this figure shows, the weft threads run in an arched manner such that they have a smaller spacing from the breast beam in the central region across the fabric than at the edges. There are measures whereby this weft arching can be limited, but not to such an extent that a rectangular matrix of weft threads and warp threads can be obtained to meet the requirements for woven labels.

Figure 2:
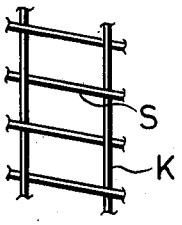
Figure 3:
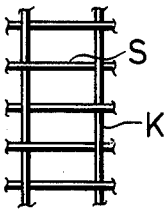

FIGS. 2, 3 and 4 show respective portions from one edge, the central region, and the outer edge of the fabric of FIG. 1, and it is to be noted that the weft threads run perpendicularly to the warp threads only in the portion of FIG. 3. Accordingly, if a strip parallel to the warp threads is cut from the right hand base (corresponding to FIG. 4) of a broad patterned fabric woven in conventional manner, and the relevant strip is then cut into rectangular labels, the weft threads of the resultant labels are angled relative to the cuts, as shown in FIG. 5. Such a woven label is of practically unsaleable quality.

An object of the present invention is to obviate the difficulty arising from this arching and to this end the invention provides a method of manufacturing a plurality of patterned strips of fabric from threads of synthetic material, which method comprises:

weaving on a broad weaving machine a unitary broad fabric composed of said strips extending in parallel relation along the warp direction of said fabric;

conveying said fabric from the point of said machine where the sley beats up the fabric at a sufficiently low warp tension that a boxing condition occurs to obviate weft arching;

guiding the woven fabric after passage past the sley to allow movement towards the breast beam of said machine, but not in the opposite direction;

cutting the guided woven fabric in the warp direction to separate said strips;

heating the cut edges of said strips to weld said edges; and further heating said strips to relieve varying tensile stress therein by thermo-stabilization.

For a fuller appreciation of this more general statement of the method and apparatus of the invention, it is to be understood that "boxing" is a condition which occurs if the warp thread tension becomes so low that the warp threads do not automatically follow predictable paths after the sley stop. The invention takes advantage of the fact that this condition allows the sley to push the weft threads into rectilinear dispositions at the point where the sley beats up the fabric so as to produce a fabric in which the warp and weft threads form a rectangular matrix. At the same time, provision is made shortly after passage past the sley for guiding the fabric to allow movement towards the breast beam, but not in a reverse direction.

However, this first measure of the method of the invention leads to a further difficulty in that the pushing of the weft threads into rectilinear rather than arched dispositions produces a variation in tension in the warp threads, these threads being at a higher tension at the edges of the woven fabric where the weft threads are pushed further than usual, and lowest in the central regions of the fabric. Then, in the absence of any measures to the contrary, the fabric, and also strips cut therefrom parallel to the warp threads, will tend to ripple.

This further difficulty is obviated in part by the second measure of the method of the invention which involves melting the edges of the strips cut from the fabric to weld the threads at these edges and fix the same against rippling, as well as obviate fraying.

Nevertheless, although the strips are effectively fixed in a desired geometrical form, the strips are not in a fully satisfactory condition in so far as the varying tension of the warp threads still remains. This disadvantage is met by the third main measure of the method of the invention whereby the strips are heated to relieve the tensile stress by thermo-stabilization.

In carrying out the method of the invention, it is preferred that the fabric cutting operation is effected in an indirect manner by heat radiation, rather than in a direct manner as by a knife. Also, it is preferred that this cutting head radiation be at as low a temperature as possible. This cutting and edge heating temperature is suitably about 300° C and the further heating of the entire body of strips is at a temperature of about 100° C to relieve tensile stresses by thermo-stabilization.

Turning to the question of apparatus for carrying out the above-discussed method, the invention also involves the provision of a broad fabric weaving machine including a fabric guiding station extending across the width of said machine at the output from the point where the sley beats up the fabric in the direction towards the breast beam. The guiding station includes a slot and a rounded guide bar therebehind to define a re-entrant part-annular path for passage of woven fabric into said slot. The broadly woven fabric then moves round said bar, and back out of said slot to a cutting station downstream from said guiding station in the fabric path to the breast plate. The heating and cutting station includes a plurality of cutting means successively spaced across said machine to heat and cut said woven fabric into parallel strips and to heat the cut edges of said strips to weld the same; and a second heating station extending across the width of said machine downstream from said heating and cutting and station towards said breast beam, to effect thermostabilization of said strips.

Preferably, in such a machine, a guide bar additionally functions to stabilize the fabric in the weft direction by the provision of a left-hand thread on the right-hand side of its length relative to flow towards the breast beam and a right-hand thread on the other side.

The cutting and welding is preferably effected by the essentially simultaneous use of hot wires and plates over which the cut edges are passed, and the stress-relieving thermostabilizing is preferably effected by a heating element extending across the width of the fabric path at a point where the machine is recessed below the width of the fabric for free passage of the fabric thereover and to assure saturation heating of the entire body of the fabric.

Also, in order to facilitate practical implementation of the invention on the basis of currently available broad fabric weaving machines, it is convenient to modify such a machine by the provision of a carrier to extend transversely over the machine between the sley stop and the breast beam. The carrier has an undercut slot in its side facing the sley, behind which slot the guide bar is supported. The carrier also supports fabric cutting heating wires extending outwardly from the carrier above the undercut slot, and a stress-relieving heating element above a recess in the carrier. In any such modification, it is important inter alia that the warp beam of the original machine is retained, but not the individual warp discs.

Further features of the invention will be apparent from a consideration of FIGS. 6 and 7 of the drawings which comprise a sectional view and a partial plan view of one embodiment of the above-mentioned carrier.

The main body of the carrier is denoted at 10 and the associated path of the warp threads is indicated by the arrowed broken line G commencing in the bottom righthand corner where 24 indicates the position of the broad weaving maching where the sley beats up the fabric. The woven fabric then passes through a slit opening or slot which extends across the carrier and opens in an undercut manner into a recess or cavity 22 provided across the width of the carrier and extending behind the length of the slot therein. The fabric is wrapped around a rounded guide bar 23 located in recess 22, and then comes out of the slot again and continues around an overhanging lip or outside edge of the surface of the carrier 10. It is important that the bar 23 is mounted to be freely rotatable in a radial sense, but it is not essential for the bar to be located in a recessed cavity for it can be arranged below an undercut slot or overhanging lip or edge of a supporting surface on the carrier 10 over which th fabric runs.

After coming out of the slot, the fabric runs on the surface of the carrier 10 first towards the cutting station. This station includes a plurality of individual cutting and heating blade means 15 arranged at successively spaced locations across the width of the carrier in the direction of the weft threads as shown in FIG. 7. The carrier 10 is recessed in its upper right-hand side as shown in FIG. 6 to receive components 11, 12 and 14 in which the cutting and heating blade means 15 are supported. The components 12 and 14 are of electrically insulating ceramic material and have slits formed therein which run parallel to the warp threads. A respective metal heating plate 15 is located and fastened in respective ones of these slits and are spaced apart at a distance equal to that of the desired width for the strips to be cut. Each of these metal plates 15 projects into an opening between components 11 and 12 that extends across the width of the carrier 10 and is connected to a common electrical connector bar 18. The right-hand side of each plate 15 also projects beyond the right-hand end of the components 12 and 14, and includes a downwardly pointing finger to which is connected a respective heating wire 16 for beating and cutting. Each of the heating wires 16 pass through respective passages in the component 14 and are held in insulating supports or sleeves 25 before continuing to connect with another common electrical connector bar 17. The common connector bars 17 and 18 are seen to extend across the width of the carrier 10 and are supported in the generally V-shaped recess or opening between the components 11 and 12. The bars 17 and 18 serve to energize in parallel manner each of the heating wires 16 and its series connected respective heating plate 15. This mode of electrical connection has the advantage that failure of any individual series connected wire/plate combination can be determined by use of a simple null current detection arrangement.

After passing through the cutting station and being cut into strips and the cut edges heated to avoid ripping, the fabric passes over the V-shaped recess between components 11 and 12 and then runs over a further recess 19 in the upper left-hand surface of the carrier 10. At this point, the fabric passes under a radiant heating rod 20 positioned opposite the recess with the recess 19 and rod 20 extending across the entire width of the carrier. The rod 20 is backed by a protective heat reflecting shield 21 for saturation heating of the entire body of the strips.

In use, the illustrated embodiment operates in the following manner: the fabric is woven by conventional and known techniques under a low warp tension to obviate weft arching using a currently available broad fabric weaving machine. After weaving and passage through the sley stop of the broad fabric weaving machine, the broad fabric passes into the slotted recess 22, round the guide bar 23 and out again over the overhanging lip and exterior side surface of carrier 10 to the cutting station in a free-wheeling motion. The fabric is then cut into strips by the heating wires 16 and the cut edges are melted at substantially the same time to prevent rippling. Finally, the cut strips of fabric pass over the upper surface of carrier 10 to heater 20 where they are heated in a freely supported manner over the recess 19. As a result, the cut strips are thermo-stabilized to relieve remanent tensile stress variations.

What is claimed is:

1. A method of forming a plurality of patterned strips of fabric woven from threads of synthetic material using a broad weaving machine having a sley and a breast beam, which method comprises:

weaving on the broad weaving machine a unitary broad fabric with said strips to be formed extending in parallel relation along the warp direction of said fabric;

conveying said fabric from the position where the sley of said machine beats up the fabric at a sufficiently low warp tension that a boxing condition occurs to obviate weft arching;

guiding the woven fabric leaving the position where the sley beats up the fabric to allow movement towards the breast beam of said machine, but not in the opposite direction;

cutting the guided woven fabric in the warp direction with a heated cutting blade means maintained at a first temperature of at least about 300° C to form strips whereby the edges are welded by the heat and thereby avoids ripping;

separating said strips;

and thereafter further heating the entire body of said separated strips at a second temperature lower than said cutting temperature to relieve varying tensile stress therein by thermostabilization.

2. In a broad fabric weaving machine having a sley and a breast plate for forming a plurality of strips of fabric from threads of synthetic fiber, the improvement comprising:

a fabric guiding station extending across the width of said machine at the output from the machine where the sley beats up the fabric and ahead of the breast plate, said fabric guiding station comprising a slot and a rounded guide bar therebehind to define a re-entrant part-annular path for passage of woven fabric into said slot, round said bar and back out of said slot;

said guide bar being formed with a left-hand fabric guided thread over the right-hand half of its length in the direction towards a cutting station, and a right-hand guiding thread over its left-hand half;

a heating and cutting station downstream from said guiding station in the fabric path to said breast plate, which station includes a plurality of electrically heated cutting wires successively spaced across the width of said machine in the direction of the weft and extending into the path of the fabric for heating and cutting said woven fabric into desired width separated strips parallel to the warp of the fabric and for heating the cut edges of said strips to weld the same;

and a second heating station comprising an elongated heating member to heat said separated strips extending across the width of said machine downstream from said hot wire cutting and cut edge heating station towards said breast beam for heating the strips at a temperature lower than said cutting temperature to effect thermostabilization of said strips.

3. A machine according to claim 2, wherein said heating and cutting station comprises a unitary structure with each of said cutting wires mounted on a heating plate and extending through the fabric path so as to serve to prevent the cut edges from reuniting.

4. A machine according to claim 3, wherein each of said electrically heated cutting wires is electrically connected in series circuit relationship with its respective cut edge heating plate and the series connected cutting wire/heating plate combinations are connected in parallel circuit relationship to a common energizing source.

5. A machine according to claim 3, wherein said elongated heating member extends across the width of said machine adjacent a recess over which said fabric passes in freely supported manner, and said heating member and recess are spaced apart for passage of said fabric therebetween.

6. A machine according to claim 2, wherein said guiding, cutting and heating stations are formed in and supported by a common carrier itself comprising an attachment to be mounted on conventional broad fabric weaving machines intermediate the position where the sley beats up the fabric and the breast plate.

* * * * *